United States Patent [19]

Roberts

[11] 3,938,511

[45] Feb. 17, 1976

[54] MOUTHPIECE REGULATOR FOR AN UNDERWATER BREATHING APPARATUS

[75] Inventor: Robert E. Roberts, Torrance, Calif.

[73] Assignee: Under Sea Industries Of Delaware, Inc., Compton, Calif.

[22] Filed: July 26, 1974

[21] Appl. No.: 492,058

[52] U.S. Cl. ..... 128/142.2; 137/102

[51] Int. Cl.[2] ..... A62B 7/04

[58] Field of Search ..... 128/142.2, 142.3, 142, 128/146.5, 146.4, 145.5, 145.8; 137/102, 508

[56] References Cited

UNITED STATES PATENTS

| | | | |
|---|---|---|---|
| 1,608,618 | 11/1926 | Richards | 137/508 |
| 2,483,698 | 10/1949 | Goodner | 128/145.8 |
| 2,893,415 | 7/1959 | Arenhold et al. | 137/102 |
| 3,545,485 | 12/1970 | Clark | 137/508 |

*Primary Examiner*—Robert W. Michell
*Assistant Examiner*—Henry J. Recla
*Attorney, Agent, or Firm*—Flam & Flam

[57] ABSTRACT

A mouthpiece regulator for an underwater breathing apparatus utilizes a unitary valve member to perform both inhalation pressure sensing and inlet valve functions. The valve member includes a hollow stem that projects into an inlet chamber in the regulator housing. The stem end cooperates with a valve seat to function as an inlet valve. The valve member also has a wide flange at the other end of the stem. The flange divides the regulator interior chamber into two regions, one communicating with the mouthpiece, the other communicating via ports with the ambient environment. During inhalation the environmental air or water pressure exerted on the flange causes the inlet valve to open, supplying air to the mouthpiece via the hollow stem. At the end of inhalation, increased mouthpiece pressure and a bias spring together cause the unitary valve member to close the inlet valve. Exhaled gases are expelled via a flap valve covering exhaust openings through the flange.

5 Claims, 3 Drawing Figures

MOUTHPIECE REGULATOR FOR AN UNDERWATER BREATHING APPARATUS

BACKGROUND OF THE INVENTION

1. Field of the Invention

The present invention relates to a mouthpiece regulator for a self contained underwater breathing apparatus (scuba), and particularly to such a regulator employing a simplified inlet valve and inhalation pressure responsive structure.

2. Description of the Prior Art

A typical prior art scuba mouthpiece regulator includes (1) a diaphragm sensitive to inhalation/exhalation pressure changes during the breathing cycle, (2) an inlet valve that controls the delivery of breathable gas from the supply tank to the mouthpiece, and (3) a mechanical linkage interconnecting the diaphragm and the inlet valve to cause the valve to open during inhalation. The regulator also includes (4) a separate exhaust port and associated flap closure to exhaust the exhaled gas. This conventional organization is illustrated by the Dalla Valle mouthpiece regulator of U.S. Pat. No. 3,101,732.

While the above described regulator is quite efficient and is widely used, its complexity and relatively large number of components results in increased cost. An object of the present invention is to provide a mouthpiece regulator having significantly fewer components and simplified construction. Resultant benefits include reduced cost and improved reliability, this being of particular importance since life literally depends on proper functioning of the regulator during underwater use.

Another problem associated with prior art mouthpiece (second stage) regulators is that their operation is not independent of the incoming air pressure level. For example, the pressure of the supplied breathable gas may be exerted directly on the valve member that is controlled by the diaphragm linkage. As a result, regulator performance will vary somewhat as changes occur in the breathable gas pressure level supplied from the scuba tank and first stage regulator. Another object of the present invention is to provide a mouthpiece regulator that operates substantially independently of the incoming air pressure level.

SUMMARY OF THE INVENTION

These and other objectives are achieved by providing a mouthpiece regulator in which the functions of diaphragm, linkage and inlet valve are combined into a unitary valve member. This valve member includes a cylindrical stem which projects into an inlet chamber in the mouthpiece housing. The stem end cooperates with a valve seat in the housing to function as the inlet valve.

The unitary valve member also includes a flange at the other end of the stem. This flange separates an interior chamber of the mouthpiece housing into two regions, one of which includes the mouthpiece opening. A spring in this region biases the valve member away from the mouthpiece and toward the position in which the stem end abuts against the valve seat to close the inlet valve. Ports in the housing sidewall admit ambient air or water into the interior region on the other side of the flange.

The area of the flange is sufficient so that when the mouthpiece pressure is reduced during inhalation, the ambient air or water pressure exerted on the opposite side of the flange will overcome the spring bias and cause the inlet valve to open. Breathable gas flows through the cylindrical stem to the mouthpiece region of the regulator. Near the end of the inhalation cycle, increased pressure in the mouthpiece region balances the ambient pressure, and the spring causes the inlet valve to close.

Exhaled gases are exhausted via openings through the flange. A flap valve, attached to the unitary valve member, covers the exhaust openings on the side exposed to the environment. This one-way flap valve is urged open by the exhaled gases which are expelled from the regulator via the flange openings, the chamber region exposed to the environment and the sidewall ports.

BRIEF DESCRIPTION OF THE DRAWINGS

A detailed description of the invention will be made with reference to the accompanying drawings wherein like numerals designate corresponding elements in the several figures.

DESCRIPTION OF THE PREFERRED EMBODIMENT

The following detailed description is of the best presently contemplated mode of carrying out the invention. This description is not to be taken in a limiting sense, but is made merely for the purpose of illustrating the general principles of the invention since the scope of the invention best is defined by the appended claims.

Figure 1:
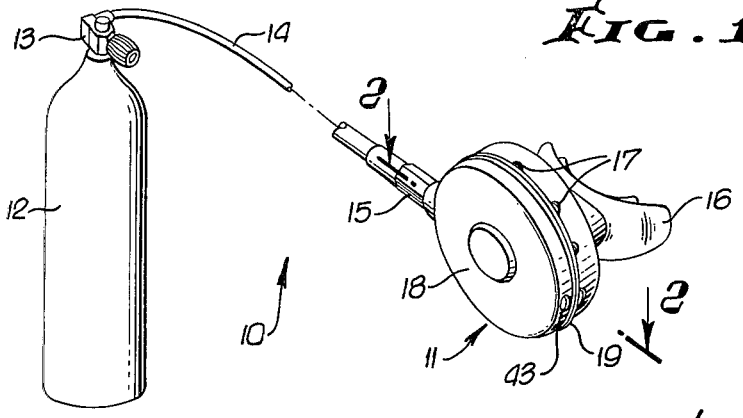
FIG. 1 is a pictorial view of a self contained underwater breathing apparatus employing the inventive mouthpiece regulator.

FIG. 1 shows an underwater breathing apparatus 10 employing the inventive mouthpiece regulator 11. The apparatus includes a supply tank 12 of breathable gas and an associated regulator first stage 13 used to reduce the very high tank pressure to a level on the order of 140 psi. Breathable gas at this pressure is supplied via an inlet hose 14 connected to the regulator 11 by an appropriate fitting 15. The regulator 11 is provided with a rubber or equivalent mouthpiece 16 that is held in the diver's mouth. The regulator 11 functions to supply breathable gas to the diver on demand during the inhalation cycle. During exhalation, the exhaled gases are exhausted from the regulator 11 through ports 17 in the regulator housing 18.

Figure 2:
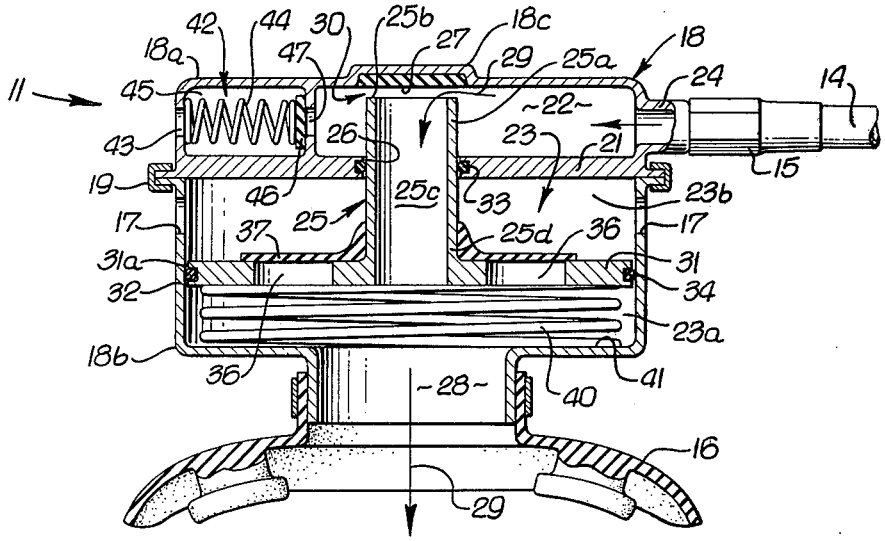
FIG. 2 is a transverse sectional view of the mouthpiece regulator of FIG. 1 as viewed along the line 2—2 thereof. The regulator is shown during the inhalation cycle with the inlet valve open.
Figure 3:
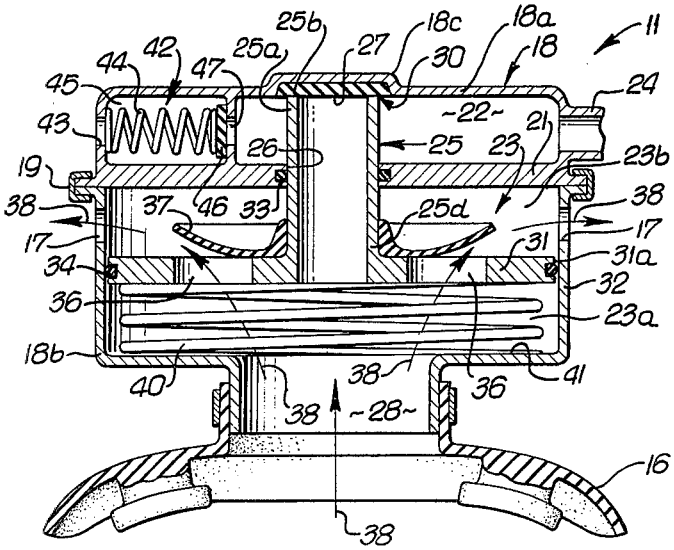
FIG. 3 is a transverse sectional view like that of FIG. 2, except that the regulator is shown during the exhalation cycle with the inlet valve closed and the exhaust flap valve open to permit the outlet of exhaled gases.

As shown in FIGS. 2 and 3, the regulator housing may be formed in two sections, 18*a*, 18*b* securely fastened by an appropriate annular clip member 19. The section 18*a* includes an interior wall 21 which divides the housing interior into two parts, an inlet chamber 22 and an interior chamber 23. Breathable gas from the hose 14 is supplied to the inlet chamber 22 via a threaded projection 24 that receives the fitting 15. Air supply to the mouthpiece 16 is controlled by a unitary valve member 25. This member 25 includes a cylindrical stem 25*a* that extends through an opening 26 in the interior wall 21. The end 25*b* of the stem 25*a* cooperates with a valve seat 27 to function as the inlet valve for the regulator 18. The valve seat 27 simply may comprise a disk of plastic or like material rigidly mounted in a boss 18*c* formed in the regulator housing opposite the mouthpiece outlet 28.

When the stem end 25*b* is spaced from the seat 27 as shown in FIG. 2, breathable gas can flow from the inlet chamber 22, past the stem end 25*b*, and through the stem interior 25*c* to the mouthpiece outlet 28, as indicated by the arrows 29. When the unitary valve member 25 is situated as shown in FIG. 3, the stem end 25*b* abuts against the seat 27 to block the flow of gas from the inlet chamber 22 to the mouthpiece outlet 28. Thus, the stem end 25*b* and the seat 27 together function as an inlet valve 30 of the knife-edge type.

The unitary valve member 25 also includes a flange 31 extending from the other end 25*d* of the stem 25*a*. The periphery 31*a* of the flange 31 conforms to the inside shape of the housing sidewalls 32 defining the interior chamber 23. Thus the flange 31 divides the chamber 23 into two regions, a first region 23*a* communicating with the mouthpiece outlet 28, and a second region 23*b* communicating with the exhaust ports 17. The latter region 23*b* of course is exposed to the environment, and fills with water during a dive. An O-ring 33 around the opening 26 and an O-ring 34 at the periphery of the flange 31 respectively prevent leakage of water from the region 23*b* into the inlet chamber 22 or into the mouthpiece region 23*a*.

One or more exhaust openings 36 extend through the flange 31. These are covered by a resilient valve flap 37 situated within the region 23*b*. The valve flap 37 may comprise a generally annular shaped rubber or like member attached at its inner periphery to the stem 25*a*.

During exhalation (FIG. 3), the exhaled gases flow through the mouthpiece region 23*a* and through the exhaust openings 36, forcing the outer portion of the valve flap 37 to open away from the flange 31. This permits the exhaled gases to flow past the valve flap 37, through the environment-filled region 23*b* and out of the regulator 11 via the ports 17, as indicated by the arrows 38.

A bias spring 40 situated in the mouthpiece region 23*a* urges the unitary valve member 25 toward the closed position shown in FIG. 3. Preferably, one end of the compression spring 40 seats on a shoulder 41 of the housing 18 surrounding the mouthpiece opening 28. The other end of the spring 40 abuts against the flange 31 radially outwardly of the exhaust openings 36.

Normally the force exerted by the spring 40 overcomes the counterforce exerted on the other side of the flange 31 by the ambient environment in the region 23*b*. However, during inhalation (FIG. 2) the pressure in the mouthpiece region 23*a* is reduced. As a result, the force exerted by the air or water in the region 23*b* is sufficient to overcome the spring 40 pressure, and hence to move the unitary valve member 25 toward the mouthpiece 16 so as to open the inlet valve 30.

Near the end of the inhalation cycle, the pressure in the mouthpiece region 23*a* increases. This increased pressure, together with the force of the spring 40, is sufficient again to overcome the counterforce of the ambient environment in the region 236. As a result, the unitary valve member 25 again is urged to the closed position (FIG. 3), completing the inhalation cycle. During exhalation the pressure in the mouthpiece region 23*a* increases even more, so that the unitary valve member 25 remains in closed position as exhaled gases are expelled as described above.

Thus the unitary valve member 25 replaces the diaphragm, mechanical linkage and inlet valve of a prior art mouthpiece regulator. The result is a simpler, more reliable construction with fewer parts. Due to its knife-edge type configuration, operation of the inlet valve 30 is substantially independent of the incoming air or breathable gas pressure.

Should the incoming air pressure exceed some preset value, a relief valve 42 will open to vent the excess pressure via a port 43. The relief valve 42 consists of a spring 44 situated in an interior region 45 of the housing section 18*a*. The spring 44 biases a valve closure 46 into closing relationship with an aperture 47 between the inlet chamber 22 and the region 45, as shown in FIGS. 2 and 3. When the incoming air pressure is excessive, it forces the closure 46 away from the aperture 47, overcoming the spring 45 force. A vent path is provided via the aperture 47 and the port 43.

Intending to claim all novel, useful and unobvious features shown or described, the applicant claims:

1. In the second stage regulator for scuba diving equipment:

a. a housing;

b. said housing having a partition dividing said housing into two compartments, namely, an inlet compartment and a control compartment;

c. a movable wall in the control compartment and dividing said control compartment into two separate chambers, namely an ambient chamber and a breathing chamber, the ambient chamber adjoining the inlet compartment;

d. a mouthpiece in open communication with the breathing chamber;

e. said movable wall having a relatively rigid tubular part open at both ends and fixedly, secured to said wall, one end of said tubular part being in continuous communication with said breathing chamber; said tubular part projecting through said ambient chamber through said partition and into said inlet compartment;

f. first seal means between said partition and said tubular part;

g. said housing having ports for admitting ambient fluid into said ambient chamber for exertion of pressure upon said movable wall;

h. spring means acting upon the wall and opposing the fluid pressure of said ambient chamber for urging said wall in a direction to project said tubular part through said partition; said spring means yielding to said ambient pressure upon a reduction of pressure in said breathing chamber;

i. second seal means in said inlet compartment and engaged by the other end of said tubular part to seal the tubular part;

j. means conducting breathable gases under pressure to said inlet compartment for passage through said tubular part and into said breathing chamber upon movement of said wall in a direction to move said tubular member from said second seal means;

k. means forming an exhalation valve from said ambient chamber;

l. said breathing chamber being otherwise sealed to confine flow to the tubular part, the mouthpiece, and the exhalation valve.

2. The combination as set forth in claim 1 in which the effective area of the first seal means about said tubular part substantially equals the effective area of said second seal means at the end of said tubular part whereby the operation of said movable wall is substantially independent of the pressure at said inlet compartment.

3. The combination as set forth in claim 2 in which said exhalation valve comprises a circularly extending flexible and resilient member mounted on said tubular part and located in said ambient chamber, said circularly extending member overlying ports in said movable wall.

4. The combination as set forth in claim 1 in which said exhalation valve comprises a flexible and resilient flap carried by said movable wall and located in said ambient chamber, said flap overlying ports in said movable wall.

5. The combination as set forth in claim 1, in which said movable wall is rigid and is guided by the housing for rectiliniar movement therein; and third seal means between said housing and said movable wall.

* * * * *